US009271537B2

(12) United States Patent
Nelson

(10) Patent No.: US 9,271,537 B2
(45) Date of Patent: Mar. 1, 2016

(54) ENERGY DIFFUSING HELMET ASSEMBLY

(71) Applicant: Thomas Nelson, Edmonton (CA)

(72) Inventor: Thomas Nelson, Edmonton (CA)

( * ) Notice: Subject to any disclaimer, the term of this patent is extended or adjusted under 35 U.S.C. 154(b) by 189 days.

(21) Appl. No.: 13/967,554

(22) Filed: Aug. 15, 2013

(65) Prior Publication Data

US 2014/0007326 A1 Jan. 9, 2014

(30) Foreign Application Priority Data

Jul. 4, 2012 (CA) ..... 2782483

(51) Int. Cl.
*A42B 3/12* (2006.01)
*A41D 13/015* (2006.01)

(52) U.S. Cl.
CPC ..... *A42B 3/121* (2013.01); *A41D 13/015* (2013.01)

(58) Field of Classification Search
CPC ..... A42B 3/12; A42B 3/125; A42B 3/064; A42B 3/121; A42B 3/00; A42B 3/04; A42B 3/122; A42B 3/06; A42B 3/10; A42B 3/145; A42B 1/08; A41D 13/015; A41D 13/0512; A41D 13/00; A63B 71/10; A63B 2220/53; A63B 23/025; F41H 1/04
USPC ..... 2/413, 411, 417, 425, 410
See application file for complete search history.

(56) References Cited

U.S. PATENT DOCUMENTS

| | | | | |
|---|---|---|---|---|
| 3,994,022 | A * | 11/1976 | Villari et al. | 2/413 |
| 4,375,108 | A * | 3/1983 | Gooding | 2/413 |
| 5,007,111 | A * | 4/1991 | Adams | 2/22 |
| 5,131,174 | A * | 7/1992 | Drew et al. | 36/35 B |
| 6,986,170 | B2 | 1/2006 | Nelson | |
| 7,650,648 | B2 * | 1/2010 | Roberts | 2/195.8 |
| 8,327,462 | B2 * | 12/2012 | Feldman et al. | 2/2.5 |
| 8,739,317 | B2 * | 6/2014 | Abernethy | 2/413 |
| 2013/0283506 | A1 * | 10/2013 | Archbold | 2/413 |
| 2014/0020158 | A1 * | 1/2014 | Parsons et al. | 2/413 |

OTHER PUBLICATIONS

Greg McArthur and Linda Priest, Should athletes use their noggins, Globe and Mail News, May 26, 2012, p. A7.
nogginPro Inc., Athletes Everywhere: Protect Your Noggin with a Noggin(TM), Marketwire, May 24, 2012.

* cited by examiner

*Primary Examiner* — Andrew W Collins
(74) *Attorney, Agent, or Firm* — Davis & Bujold, P.L.L.C.; Michael J. Bujold

(57) ABSTRACT

An energy diffusing helmet assembly includes an outer hard shell and an inner fluid filled bladder. The hard shell defines a head cavity into which a head of a wearer is inserted. The fluid filled bladder is positioned within the outer hard shell. There is further provided a fluid filled impact dispersal field mounted on a torso of the wearer. A connective conduit connects the fluid filled bladder and the impact dispersal field. A force of impact exerted upon the fluid filled bladder increases pressure in the impact dispersal field through fluid via the connective conduit.

8 Claims, 2 Drawing Sheets

ENERGY DIFFUSING HELMET ASSEMBLY

FIELD

There is described a helmet assembly that was designed with sports injuries in mind, but which has broader application to protective helmets used in industry and military helmets.

BACKGROUND

There have been a series of incidents in which high profile athletes in the sports of hockey and football have sustained concussions, notwithstanding the fact that they were wearing state of the art protective sports helmets at the time of their injury. It is now realized that as athletes become bigger, faster and stronger, helmet technology must be improved. There is a need for a helmet that is more effective in diffusing energy in contact sports.

SUMMARY

There is provided an energy diffusing helmet assembly which includes an outer hard shell and an inner fluid filled bladder. The hard shell defines a head cavity into which a head of a wearer is inserted. The fluid filled bladder is positioned within the outer hard shell. There is further provided a fluid filled impact dispersal field mounted on a torso of the wearer. A connective conduit connects the fluid filled bladder and the impact dispersal field. A force of impact exerted upon the fluid filled bladder increases pressure in the impact dispersal field through fluid via the connective conduit.

The force of impact can be calculated as the mass of the converging athletes times their respective acceleration. It is believed that the force generated by sports impacts is getting beyond the capacity of any conventional bladder to dissipate the energy to render it relatively harmless to the athlete. The theory behind the solution proposed is drawn from the field of hydraulics. If a force of impact creates a fluid pressure of 200 pounds per square inch (psi) in a bladder of a helmet, spreading that fluid pressure over a reservoir many times larger in size should dissipate the force to lessen, if not eliminate entirely, the likelihood of injury. It will be appreciated that the same principles apply in dissipating the concussive force caused by the explosion of an improvised explosive device.

While there are various fluids that can be used, it is intended to merely create a communication of pressure and not risk vacating a portion of the fluid filled bladder. For this reason, it is preferred that the fluid used is an incompressible fluid having relatively high viscosity, such as a gel. There are also other measures that can be used to reduce fluid mobility either in addition to using a high viscosity fluid or in substitution. For example, the fluid filled bladder and the impact dispersal field may each be made with an interior divided into a plurality of compartments in fluid communication with each other. In this way, fluid would have it migrate from compartment to compartment through inlets and outlets. One example of how this might be configured is a honey comb configuration with non-aligned inlets and outlets.

It is envisaged that the impact dispersal field will disperse any impact over an area of the torso, such as the shoulders, back, abdomen or buttocks. For example, the impact dispersal field could be configured as pads positioned under the shoulder pads. However, it is preferred that the impact dispersal field be configured as a garment, such as a vest. This accomplishes a number of desirable objectives. Firstly, it is a very convenient way of mounting the impact dispersal field on the body of an athlete. Secondly, it spreads the force over the largest possible area. Thirdly, it protects other vulnerable areas of the body. Hockey and football players are not just vulnerable to head injuries, they are vulnerable to shoulder injuries and rib injuries too. In addition, it is advantageous to have vital organs similarly protected.

There is one final measure that can be incorporated in the helmet assembly. A safety release valve can be provided on the impact dispersal field. If the pressure in the fluid filled bladder and the impact dispersal field exceeds a selected threshold, fluid will be released through the safety release valve. The release of fluid in this manner serves to "extrude" excess energy from the helmet assembly into the environment.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
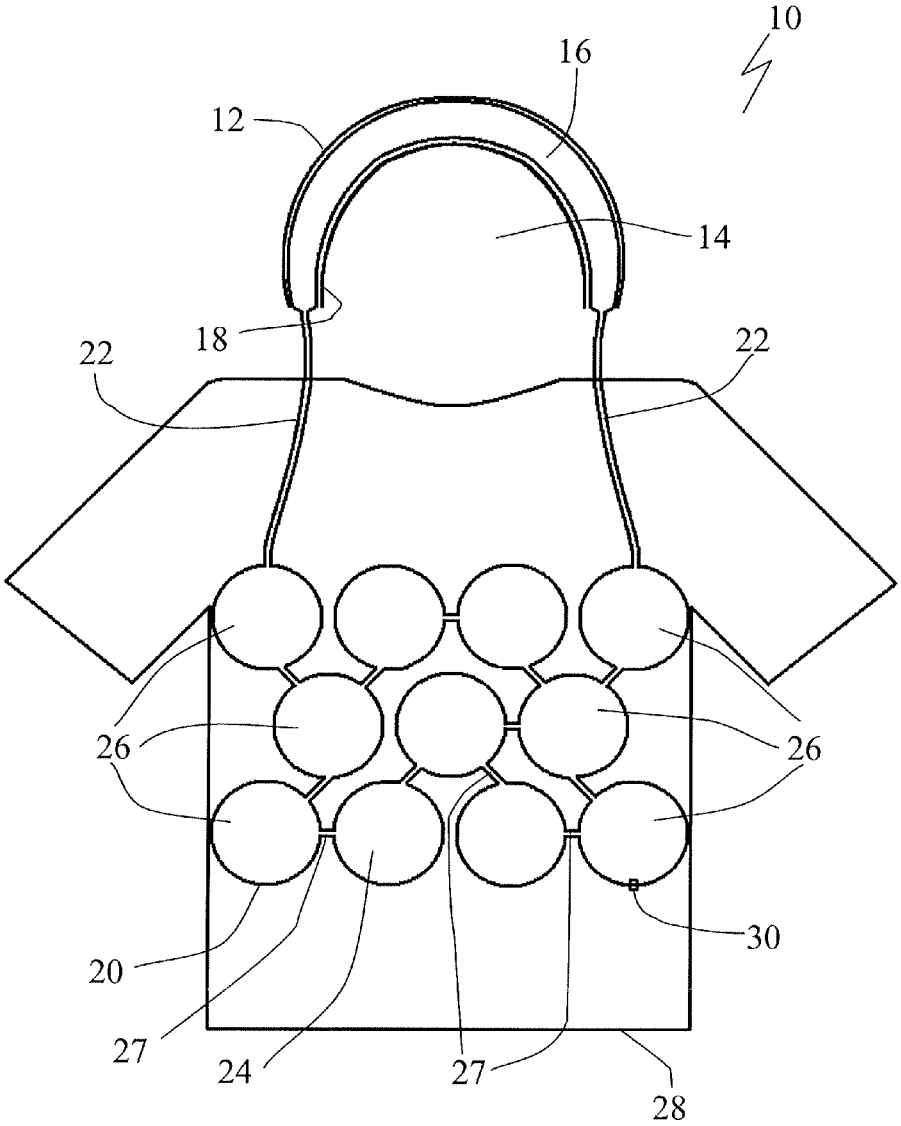
FIG. 1 is a front elevation view of an energy diffusing helmet assembly.

An energy diffusing helmet assembly generally identified by reference numeral 10, will now be described with reference to FIG. 1

Structure and Relationship of Parts:

Referring to FIG. 1, an energy diffusing helmet assembly 10 has an outer hard shell 12 defining a head cavity 14 into which a head of a wearer is inserted. An inner fluid filled bladder 16 is positioned within outer hard shell 12. An inner liner 18 is provided with inner fluid filled bladder 16 sandwiched between outer hard shell 12 and inner liner 18. Inner liner 18 may be removable to allow for cleaning after use.

A fluid filled impact dispersal field 20 is mounted on a torso of the wearer. It is preferable that the fluid used in inner fluid filled bladder 16 and fluid filled impact dispersal field 20 be a gel with a relatively high viscosity, however it will be understood that different types of fluids may be used. Fluid is intended to merely create a communication of pressure while not risking vacating a portion of fluid filled bladder 16. A connective conduit 22 connects fluid filled bladder 16 and impact dispersal field 20, such that a force of impact exerted upon fluid filled bladder 16 is shared with impact dispersal field 20. As shown in the present embodiment, impact dispersal field 20 has an interior 24 divided into a plurality of compartments 26 in fluid communication with each other. Compartments 26 with non-aligned inlets and outlets 27 help to reduce fluid mobility. Compartments 26 appear in a honey comb configuration, however it will be understood that this configuration may be altered. Fluid filled bladder 16 may also be divided into compartments. It will be understood that impact dispersal field 20 need not be divided into compartments to be effective. However, to help reduce fluid mobility, compartments 26 force fluid to migrate from compartment to compartment through inlets and outlets 27.

Figure 2:
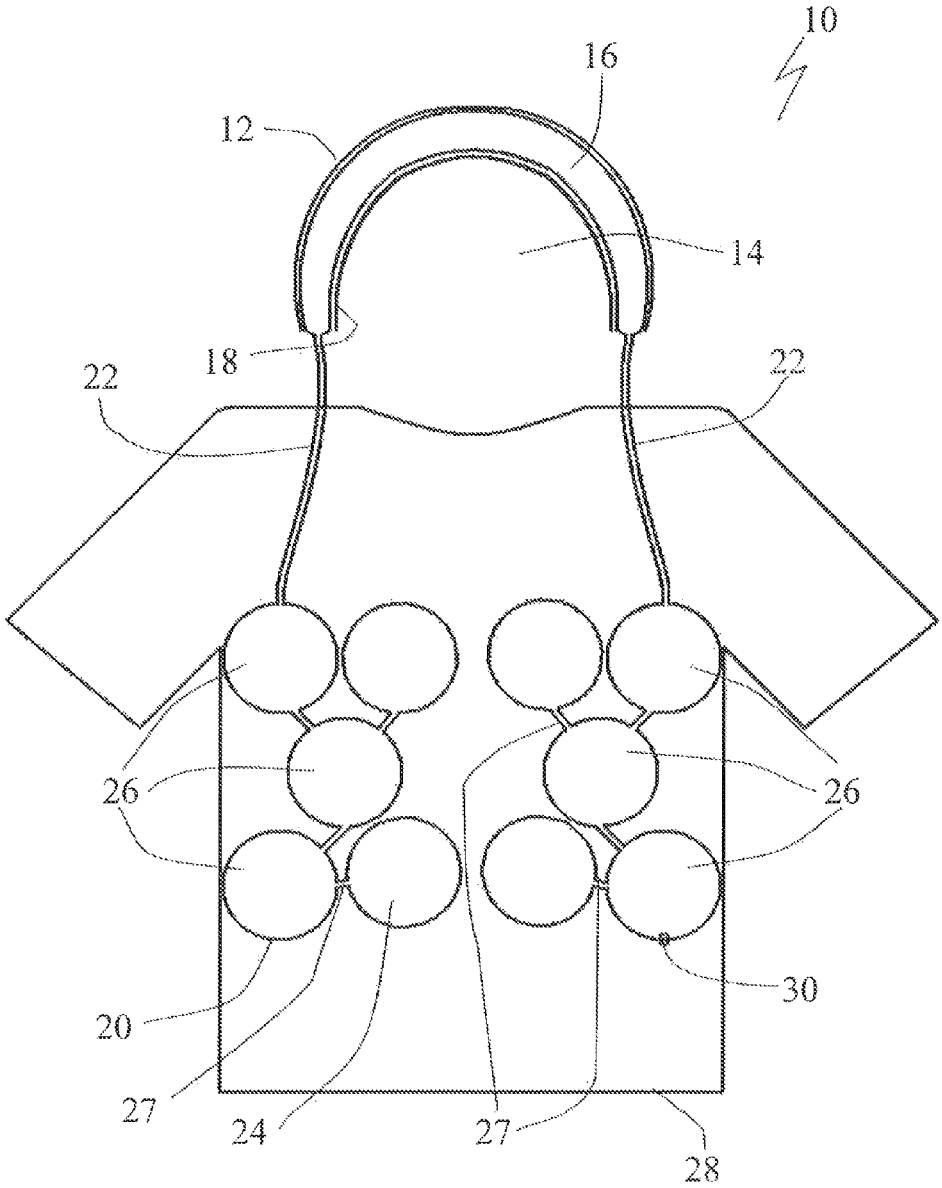
FIG. 2 is a front devotion view of an energy diffusing helmet assembly in the form of a vest.

In the embodiment shown, impact dispersal field 20 is connected to a garment 28, however it will be understood that a garment 28 is not required, or that impact dispersal field 20 may be configured into the shape of a garment. As shown in FIG. 1, garment 28 may be a shirt, however garment 28 may also be a vest, as shown in FIG. 2, or any other type of garment worn on the torso of the wearer's body.

Impact dispersal field 20 has a safety release valve 30 that allows for the release of fluid once a selected pressure threshold has been reached. The release of fluid in this manner serves to "extrude" excess energy from the helmet assembly 10 into the environment.

Operation:

In the event of an impact to outer hard shell 12 of energy diffusing helmet assembly 10, energy from the impact is transferred by fluid through fluid filled bladder 16 and dispersed through impact dispersal field 20. By dispersing the energy of the impact, the force of the impact is lessened as the force is felt over a greater area. A safety release valve 30 allows for the release of fluid in the event that a selected pressure threshold is reached. By releasing fluid from impact dispersal field 20, excess energy may be released from helmet assembly 10 and help to alleviate some of the pressure created by the impact.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the illustrated embodiments set forth as examples, but should be given the broadest interpretation consistent with a purposive construction of the claims in view of the description as a whole.

What is claimed is:

1. An energy diffusing helmet assembly, comprising:

an outer hard shell defining a head cavity into which a head of a wearer is inserted and an inner fluid filled bladder positioned within the outer hard shell;

a fluid filled impact dispersal field;

a mounting device for mounting the impact dispersal field on a torso of the wearer; and a connective conduit between the fluid filled bladder and the impact dispersal field, such that a force of impact exerted upon the fluid filled bladder is shared with the impact dispersal field with which the fluid filled bladder is in communication via the connective conduit.

2. The energy diffusing helmet assembly of claim 1, wherein the fluid is a gel.

3. The energy diffusing helmet assembly of claim 1, wherein the fluid filled bladder and the impact dispersal field have an interior divided into a plurality of compartments in fluid communication with each other.

4. The energy diffusing helmet assembly of claim 3, wherein the compartments are in a honey comb configuration.

5. The energy diffusing helmet assembly of claim 1, wherein the mounting device comprises a garment.

6. The energy diffusing helmet assembly of claim 5, wherein the garment is a vest.

7. The energy diffusing helmet assembly of claim 1, wherein the impact dispersal field has safety release valve, the safety release valve having a selected pressure threshold beyond which fluid is released.

8. The energy diffusing helmet assembly of claim 1, wherein an inner liner is provided with the inner fluid filled bladder sandwiched between the outer hard she and the inner liner.

* * * * *